US007534006B2

(12) United States Patent
Goswami et al.

(10) Patent No.: US 7,534,006 B2
(45) Date of Patent: May 19, 2009

(54) DISPOSABLE FLASHLIGHT

(76) Inventors: Vinod Kumar Goswami, 1403 La Grange St., Chestnut Hill, MA (US) 02467; Vinita Goswami, 1403 La Grange St., Chestnut Hill, MA (US) 02467

( * ) Notice: Subject to any disclaimer, the term of this patent is extended or adjusted under 35 U.S.C. 154(b) by 16 days.

(21) Appl. No.: 11/052,424

(22) Filed: Feb. 7, 2005

(65) Prior Publication Data

US 2005/0174763 A1 Aug. 11, 2005

Related U.S. Application Data

(60) Provisional application No. 60/543,149, filed on Feb. 10, 2004.

(51) Int. Cl.
*F21L 4/00* (2006.01)

(52) U.S. Cl. ..... 362/189; 362/196; 362/101; 362/394

(58) Field of Classification Search ..... 362/802, 362/196, 189, 394, 101; 200/61.47, 61.52
See application file for complete search history.

(56) References Cited

U.S. PATENT DOCUMENTS 2,118,996 A * 5/1938 Winckler ..... 429/116
2,147,116 A * 2/1939 Winckler ..... 429/116
2,226,353 A * 12/1940 Wood ..... 362/204
3,160,722 A * 12/1964 Sellers ..... 200/60
3,323,118 A * 5/1967 Tong ..... 340/321
3,798,437 A * 3/1974 Sarbacher ..... 362/189
4,171,534 A * 10/1979 Strowe ..... 362/183
6,086,216 A * 7/2000 Goldfarb ..... 362/101
6,452,121 B1 * 9/2002 Ogden ..... 200/61.46
6,511,203 B1 * 1/2003 Winther ..... 362/202
6,742,913 B2 * 6/2004 Deutsch ..... 362/253
2002/0021565 A1 * 2/2002 Alvey ..... 362/158

* cited by examiner

*Primary Examiner*—Jacob Y Choi
*Assistant Examiner*—Robert May
(74) *Attorney, Agent, or Firm*—Kaplesh Kumar, Esq

(57) ABSTRACT

A disposable flashlight uniquely suited to operation in high humidity and water exposure conditions, such as those encountered in search and rescue missions at sea. The bulb, which is preferably a high intensity super-bright light emitting diode, is energized to produce light using a battery connected to it via a switch and an electrical circuit. The switch completes the electrical circuit via an electrically conducting fluid, allowing the electrical current to flow from the battery and the bulb to illuminate.

1 Claim, 4 Drawing Sheets

DISPOSABLE FLASHLIGHT

This application claims the benefit of U.S. Provisional Application No. 60/543,149 filed on Feb. 10, 2004.

BACKGROUND OF THE INVENTION

The present invention relates generally to a disposable flashlight and more specifically to a disposable fluid-activated flashlight suited to normal usage as well as emergency situations.

Disposable flashlights have been in use for years. Examples of such devices are described in U.S. Pat. Nos. 3,796,869, 4,122,510, 4,429,352 and 4,939,626. Typically, the flashlight has a housing, battery, bulb, and switch. The bulb is lit via the switch, located on the housing of the flashlight, which completes the electrical circuit and allows the current from the battery to energize and illuminate the bulb.

A significant problem with the conventional flashlights is their unreliability in moisture and wet conditions. The circuit may be shorted and the flashlight rendered inoperable. During storage, the batteries may be weakened due to current leakage, and the switch mechanisms corroded. Such batteries are unsuited for use in emergency lighting, particularly where their use involves exposure to high humidity environments or water, as in search and rescue missions.

U.S. Pat. Nos. 5,237,491, 5,311,100, and 5,340,662 describe water-activated batteries developed for emergency operations encountering high humidity or water. These types of devices, available from sources such as A.C.R. Electronics Inc., Florida, are bulky and expensive to manufacture.

BRIEF SUMMARY OF THE INVENTION

The disposable flashlight according to the present invention departs substantially from the conventional concepts and designs of the prior art and provides a flashlight employing a novel water-activated switch mechanism that turns the light ON/OFF.

The general purpose of the present invention, described subsequently in greater detail, is to provide a new disposable water-activated flashlight that, besides having many of the advantages of the disposable flashlights mentioned heretofore, possesses novel features that are not anticipated, rendered obvious, suggested, or implied by the prior art.

An object of the present invention is to provide a disposable flashlight that lacks the shortcomings of the prior art devices for operation in water and high humidity conditions.

A second object of the present invention is to provide a disposable flashlight that operates with a water-activated switch mechanism.

Another object of the present invention is to provide a disposable water-activated flashlight that is cost effective to manufacture.

Yet another object of the present invention is to provide a disposable water-activated flashlight that is easy to customize into different shapes, colors and designs.

Still another object of the present invention is to provide a disposable water-activated flashlight that has long shelf-life, and remains illuminated for long periods.

Other objects and advantages of the present invention will be obvious to the person of ordinary skill in the art to which this invention pertains. It is intended for such objects and advantages to be within the scope and spirit of the present invention.

The present invention generally comprises of the following elements: a housing, a battery powered multi-functional light, and a switch. The multi-functional light is constructed using a bulb powered by micro-cells or small batteries. The bulb may be of the normal incandescent resistive lighting variety or may consist of at least one high intensity super-bright LED light bulb capable of emitting light in a pre-selected color. A fluid-activated control switch establishes the required electrically conducting path through the fluid for completing the electrical circuit and allowing the current to flow from the battery to the bulb to illuminate it.

There is thus outlined, rather broadly, the significant features of the invention in order that the detailed description thereof may be better understood, and the present contribution to the art better appreciated.

The disposable flashlight of the present invention is not limited in its application to the particular details of construction and the arrangements of the components set forth in the detailed description or the drawings. The invention is capable of being practiced and carried out in various ways, which would be obvious to those of ordinary skill in the art to which the invention pertains. The terminology employed herein is for the specific purpose of describing the present invention and must not be regarded as limiting.

To accomplish the above and related objects, this invention may be embodied in the form illustrated in the accompanying drawings, attention being called to the fact that the drawings are primarily for illustration, and should not be regarding as limiting. The scope of the invention is limited only by the claims and not by the drawings or description herein.

BRIEF DESCRIPTION OF THE SEVERAL VIEWS OF THE DRAWING

The objects, features, and attendant advantages of the present invention are more fully understood when considered in conjunction with the accompanying drawings, in which like reference characters designate the same or similar parts throughout the several views.

DETAILED DESCRIPTION OF THE INVENTION

Figure 1:
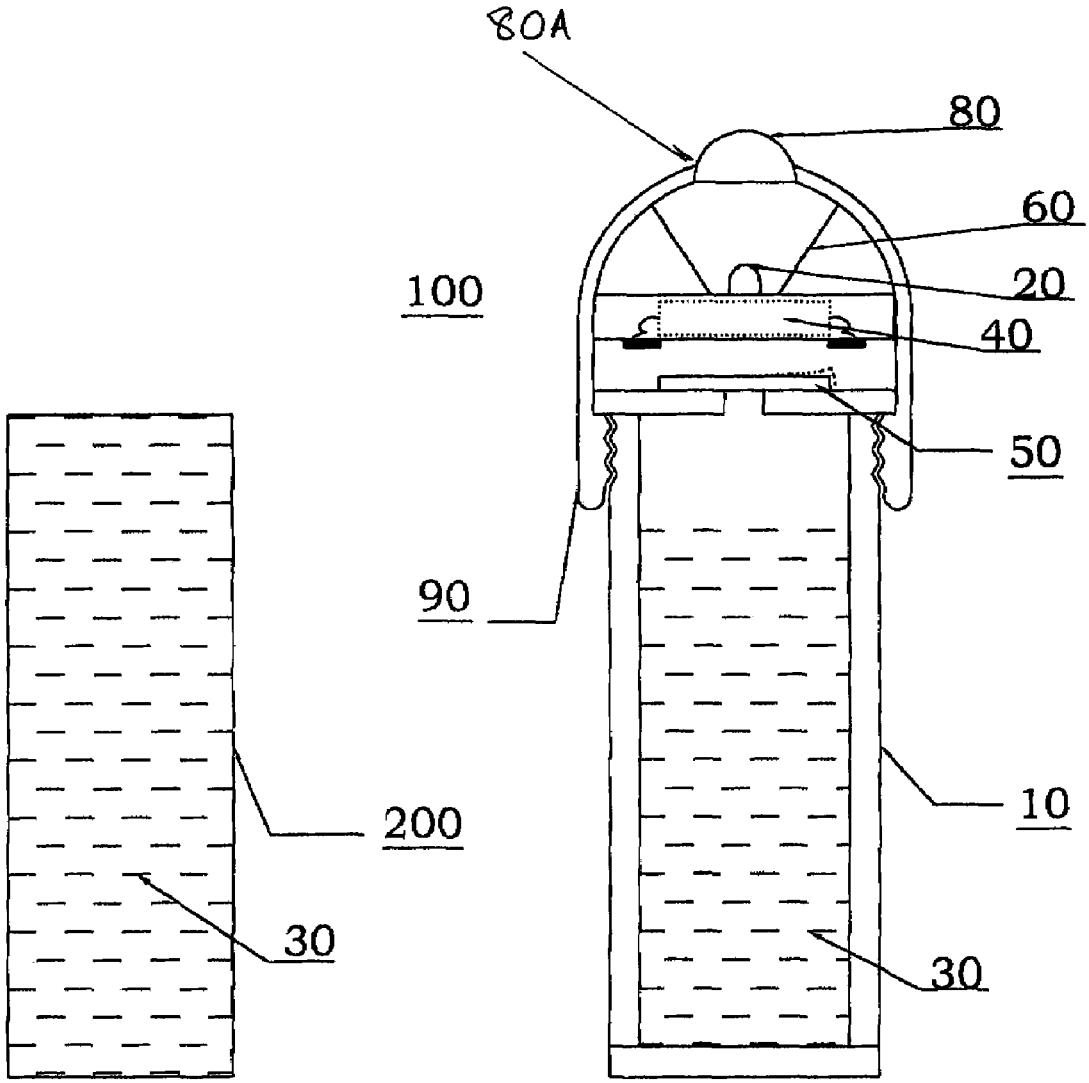
FIG. 1 is a schematic view of the disposable flashlight comprising the present invention.

FIG. 1 presents a schematic view of the disposable flashlight comprising the present invention: a housing 10, a light bulb 20, a water- or other electrically conducting fluid medium 30, a battery 40 for energizing the bulb 20, a switch 50 that allows the battery 40 to power the light bulb 20 using said water or other fluid 30, and means 90 for capturing the light bulb 20, fluid 30, and battery 40. A reflector 60 and lens 80 are optionally provided to help direct the light from the light bulb 20 and are within the scope of the present invention. A container 200 made from a low rupture strength material, such as a thin plastic membrane, within which the conducting fluid 30 may be packaged and sealed, is optionally provided for assembly into said housing 10.

Figure 2:
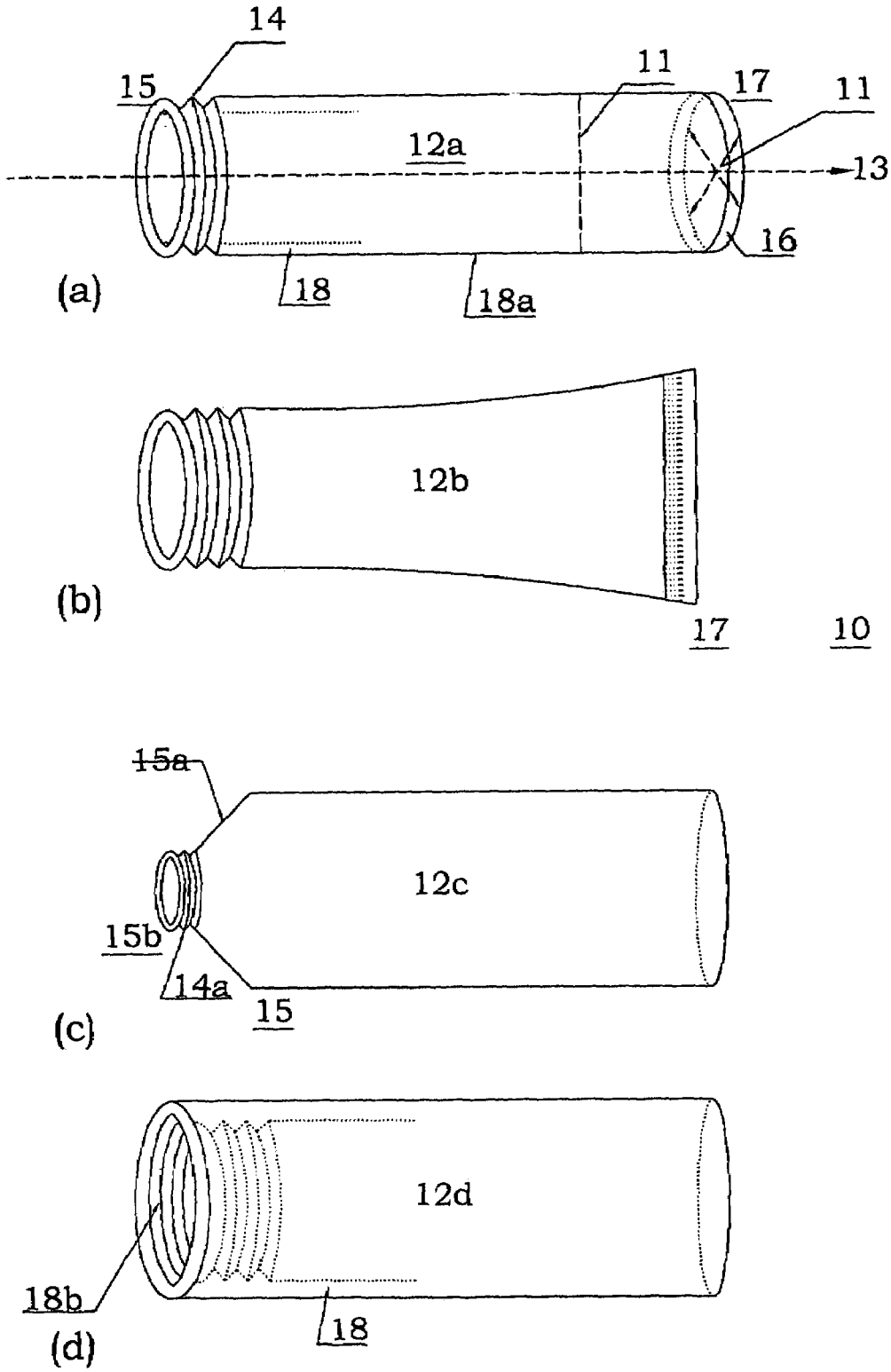
FIG. 2 presents, without limitation, several exemplary designs of the disposable flashlight's housing comprising the fluid containing compartment.
Figure 4:
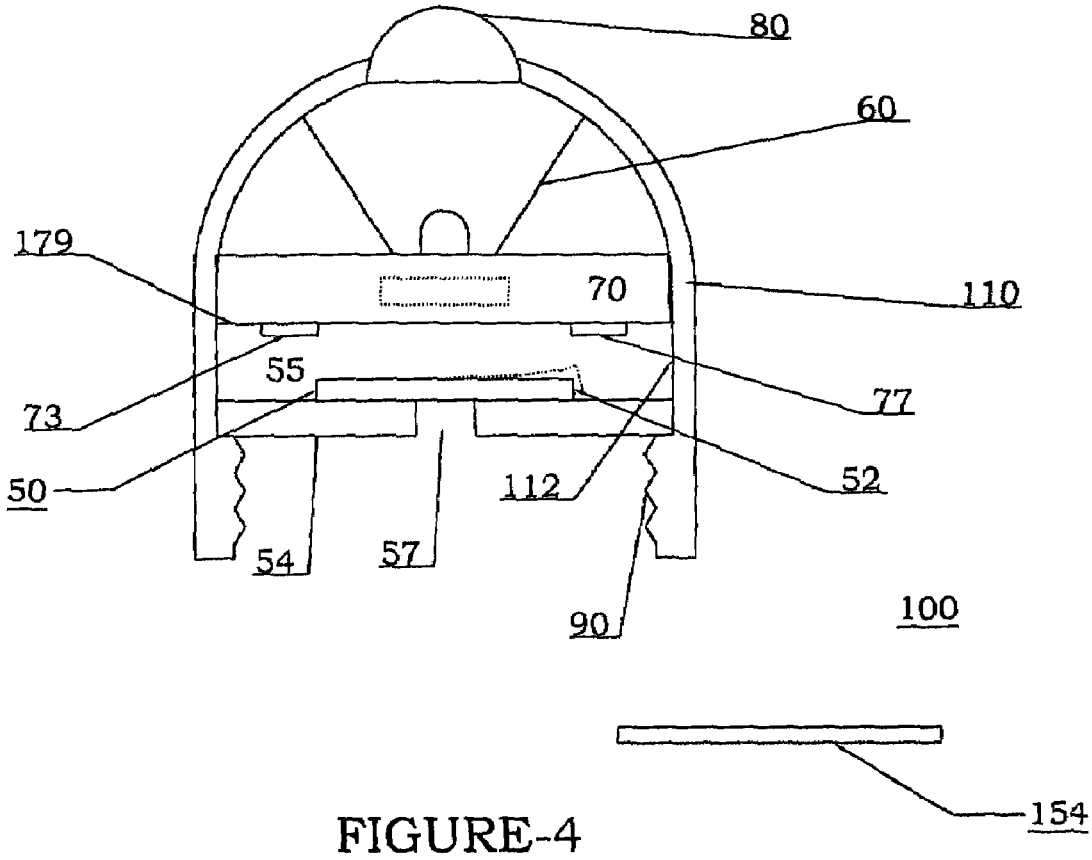
FIG. 4 shows the lens, reflector, switch, and bulb and battery subassembly within a second housing.

The housing 10 may be of single piece construction, but is preferably provided in two parts, a first housing 10 and a second housing 110. (FIGS. 2 and 4). Although the first and second housing parts 10 and 110 may be constructed from different materials, they are preferably made of plastic, which may be opaque, but is preferably translucent or transparent. The housing parts can be fabricated in a variety of colors, shapes, and sizes using commonly available cost-effective fabrication processes including, without limitation, injection molding.

Examples of design variations for housing 10 are shown in FIG. 2 (12*a*-12*d*). The housing 10 is preferably rendered in a cylindrical construction 12*a,* and designed to be mechanically compliant along directions 11 normal to its longitudinal axis 13. The housing 10 is preferably provided with a threaded termination 14 at one end 15, while the other end 17 is sealed either using an end cap 16 or by mechanically collapsing and fusing end 17 into a planar joint 19. The threads 14 are preferably provided on the external surface 18*a* of wall 18, but can also be optionally provided on its internal surface 18*b.* FIG. 2(*d*).

The threaded end 15 may be provided in different constructions, examples of which are given in FIG. 2. For instance, threaded end 15 may be narrowed using a truncated funnel construction 15*a* at end 15 that terminates into a smaller diameter threaded end 15*b* on which the threads 14*a* may be provided. Alternative fastening structures, for instance, smooth tapered fits for frictional attachment, may be provided instead of the threads 14 or 14*a,* and are within the scope of the invention. Examples of commercially available housings 10 suited to the disposable flashlight comprising the instant invention include laterally compliant plastic bottles within which shampoo, or water and soft drinks such as Aquafina, Dasani, and Coca Cola are marketed.

Figure 3:
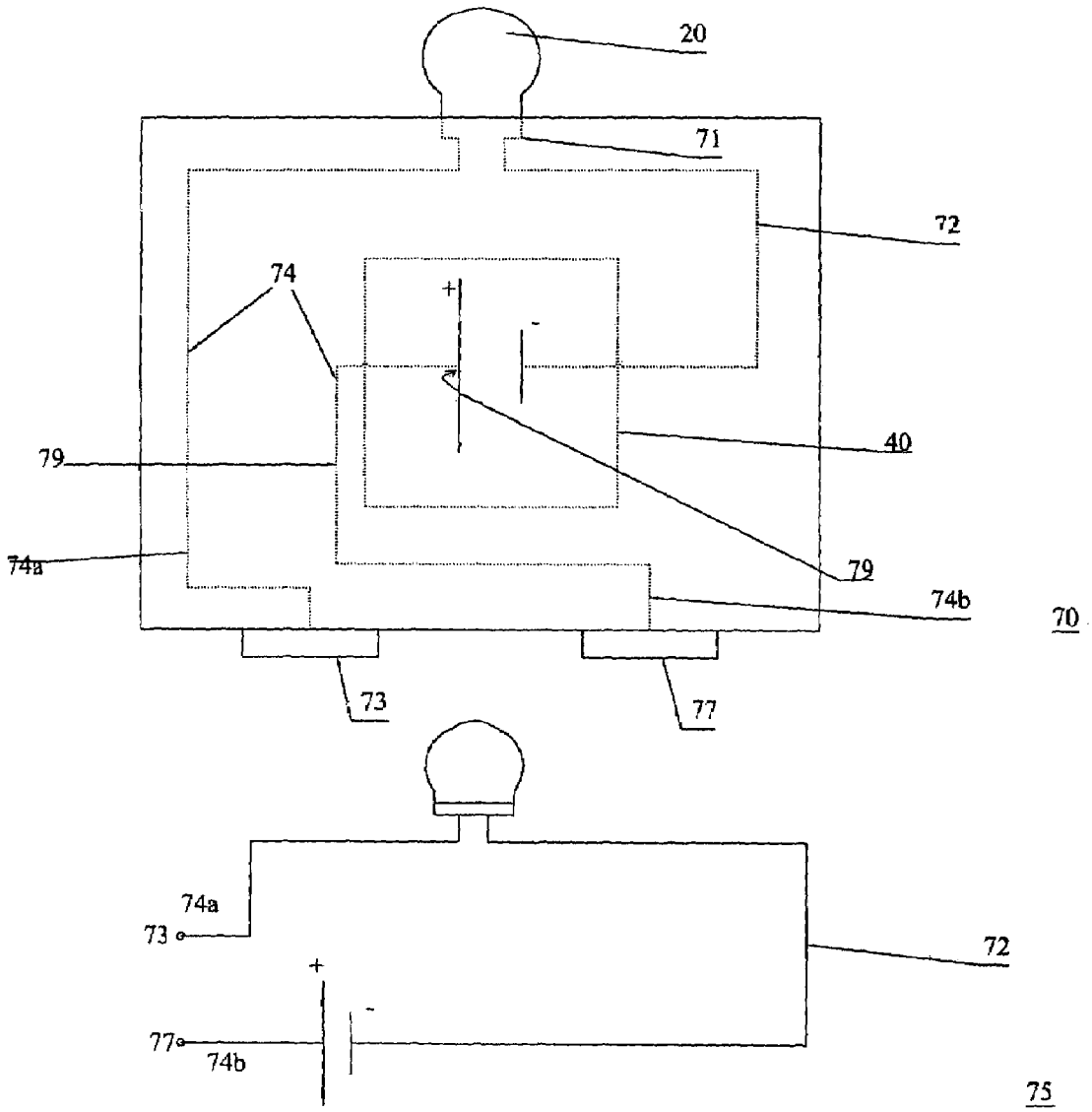
FIG. 3 shows the schematic electrical circuit diagram for the light bulb and battery module.

A light bulb 20 and battery 40 for powering the light bulb 20 may be provided as discrete components, but are preferably provided as a module 70, as in FIG. 3, in which the light bulb 20 and battery are connected electrically via leads 72 and 74. The light bulb 20 may be of standard incandescent resistive heating element construction, but is preferably at least one light emitting diode (LED). More preferably, the LED has a round spherical head and comprises at least one high intensity super-bright LED capable of emitting light in a preselected color when powered by at least one micro-cell or battery. The battery 40 is similarly of compact construction, both the bulb and battery being common in the art.

The electrical circuit 75 comprising the light bulb 20, battery 40, and leads 72 and 74 is uncompleted and rendered open electrically by providing one of the leads 74, in two segments, 74*a* and 74*b,* which are connected respectively at ends 71 and 79 to the light bulb 20 and battery 40 and terminate into electrically conducting ends 73 and 77, or other similarly active surfaces or other terminations. Alternative layout schemes may be provided and are within the scope of the present invention.

The completion of the circuit 75 requires that ends 73 and 77 be connected via an electrically conducting medium switch, whereupon power is drawn from the battery 40 and the light bulb 20 is illuminated. This light can be programmed to be constant, blinking or fading in and out. The circuit 75 is preferably of integrated circuit design and construction for cost effectiveness and ease of manufacture. Such integrated circuits are known in the art. An example of one relevant to the instant invention is described in U.S. Pat. No. 6,644,833.

The reflector 60 and lens 80 direct the light from the bulb 20 into the beam emitted by the disposable flashlight. The light from the bulb 20 radiated along the various directions is reflected from the surfaces of reflector 60 into the lens 80 so that the intensity of the radiation is maximized along the preferred direction, which is normally the direction coincidental with the longitudinal axis 13 of the housing 10. The light reflected from the reflector 60 is captured by the lens 80, which may either focus the beam at a short distance from the flashlight or render it collimated to illuminate objects at large distances. Since the disposable flashlight of the present invention can be practiced without the use of reflector 60 and/or lens 80, such a disposable flashlight without reflector 60 and/or lens 80 is deemed to be within the scope of the present invention.

The conducting medium 30 is preferably a fluid that is commonly and readily available in everyday use. Examples of fluids providing the required degree of electrical conductivity include tap or bottled water, such as marketed under the trade names of Aquafina and Poland Spring, or soda, marketed under the trade name Coca Cola. Many fluids available in the marketplace provide adequate electrical conduction. When the medium 30 contacts the electrically conducting ends 73 and 77 of leads 74*a* and 74*b,* it acts to complete the circuit, so that a separate switch 50 structural element need not be provided. The mechanism provided to contact the medium 30 with the electrically conducting ends 73 and 77 of the bulb and battery module 70, while keeping them electrically isolated when the battery is not in use, comprises the switch 50.

Complimentary means 90 are provided in the second housing 110 for fastening to similarly complementary means at end 15 of the first housing 10. Such means capture within the disposable flashlight the switch 50, light bulb and battery module 70, electrically conducting fluid 30, and reflector 60 and lens 80 where provided. One or several of these elements are either located manually inside the housing 10 or 110 or molded as an entity to produce a subassembly 100. FIG. 4. The fastening means 90 on the second housing 110 are preferably in the form of mating threads that complement similarly mating threads 14 or 14*a* at ends 15 or 15*b* of the first housing 10. Alternative fastening means, such as achieved through external clamping or frictional contacts between housings 10 and 110, are within the scope of the present invention. The subassembly 100 is secured to the housing 10 by mating with the threaded or other fastening means provided on housings 10 and 110. A switch 50 may be optionally provided which keeps the water or other fluid medium 30 in housing 10 from contacting the ends 73 and 77 of module 70.

The switch 50 may include a spring loaded compliant plastic separator 52 attached to or integral with a thin rigid flat member 54 integrated with the second housing 110. The flat member 54 is located a short distance away from module 70, and encloses a chamber 55 defined by the flat member 54, wall 112 of the second housing 110, and the exterior bottom surface 179 of module 70 where the ends 73 and 77 are exposed. The rigid flat member 54 has a perforation or similar passageway 57 that is kept sealed by the separator 52 when the flashlight is in storage and not in use. This way the fluid medium 30 is denied entry into the chamber 55 so that ends 73 and 77 do not have a conducting path between them. In use, the separator 52 can be deflected by pressurizing the fluid medium 30 in housing 10 through a squeezing action applied laterally to the compliant housing 10. This allows the fluid medium 30 to enter the chamber 55 and help establish electrical contact between ends 73 and 77.

For intermittent use, the subassembly 100 can be unfastened from the housing 10 after use, and reassembled with the flat member 54 after wiping dry the flat member 54, electrical ends 73 and 77, and chamber 55. Alternatively, intermittent use can also be accomplished by assembling the flashlight for storage using, instead of flat member 54, a single piece solid flat member 154 having no perforation, and removing the flat member 154 from the assembly when the flashlight is to be used. Then, simply tilting the flashlight to a horizontal position from a vertical one brings the fluid medium 30 in intimate contact with ends 73 and 77 to complete the circuit 75 and illuminate the light bulb 20. The tilting of the housings 10 and 110 to enable the fluid 30 to contact the ends 73 and 77 comprises the switch 50 in this embodiment of the present invention.

It is apparent that although the present invention is readily and conveniently practiced without the perforated flat member 54, its insertion is deemed to be convenient to accomplish the purposes of the invention herein. For instance, the flashlight without the flat member 54 can be assembled and stored dry, and the fluid medium 30 stored in a separate container. For use, the fluid 30 can be transferred into the housing 10, and the flashlight re-assembled without flat member 54. As soon as the flashlight is tilted, the light bulb 20 will be illuminated. After use, the flashlight can be dissembled, the fluid medium 30 transferred back into its storage container, the parts wiped dry, and the flashlight reassembled in the dry condition. Alternatively, the housing 10 can be filled with the fluid medium 30, sealed with a removable cap of a kind widely available in the art for sealing bottles that mates with the threads 14 or alternative fastening means provided, and stored separately from the subassembly 100. In use, the cap can be removed, the subassembly 100 (without the flat member 54) attached to the housing 10, and the flashlight tilted to illuminate the light bulb 20.

FIG. 1 shows the preferred embodiment of the present invention. The housing 10 is filled with water or other such suitable electrically conducting fluid medium 30, and sealed inside by fastening the subassembly 100 in FIG. 4 to the housing 10 via the fastening means 90 provided. In yet another embodiment of the preferred invention, the electrically conducting fluid 30 is packaged in a container 200 made from a low rupture strength material, such as a thin plastic membrane, and assembled into the housing 10 prior to use of the disposable flashlight. Application of lateral pressure on the housing 10, such as by squeezing, ruptures the container 200 and makes the fluid 30 available for completing the electrical circuit 75, either by directly contacting the ends 73 and 77, if they are exposed, or contacting them after being forced through switch 50 into the chamber 55, if the rigid flat member 54 is present.

While the invention described herein importantly serves as a disposable flashlight uniquely suited to wet and high humidity conditions, such as encountered during rescue missions at sea, it also has other uses by virtue of its construction. For instance, by selecting the color of the translucent plastic comprising the first 10 or second 110 housing to be red or orange, the flashlight, upon lighting, can serve as a safety beacon that may be waved to draw attention of rescuers, particularly after dark. Additionally, the housing 110 may be constructed with or without lens 80 so that there is provided a gap between its opening 80A and lens 80 or bulb 20. By blowing air across that opening with one's mouth, a whistle sound can be generated to further call attention of others.

The optimum dimensional or functional relationships of the instant invention arising from, without limitation, variations in size, materials, shape, form, function, manner of operation, assembly and use, will be readily apparent and obvious to one of ordinary skill in the art, and all equivalent relationships to those illustrated in the drawings and described in the specification are intended to be encompassed by the present invention. Since numerous modifications and changes will readily occur to those skilled in the art, it is not desired to limit the invention to the exact construction and operation shown and described herein, and all such suitable modifications and equivalents are deemed to be within its scope.

We claim:

1. A subassembly for a disposable flashlight comprising:

bulb;

battery;

an electrical circuit connecting the bulb to the battery; said bulb, battery and electrical circuit molded into a housing and having means for allowing entry of electrically conducting fluid into the housing to complete the electrical circuit and illuminate the bulb in the subassembly for the flashlight; said housing having means for fastening said subassembly to a commercially available housing, wherein the commercially available housing is a commercially available water or soda bottle.

* * * * *